US007186227B2

(12) United States Patent
Friedland

(10) Patent No.: US 7,186,227 B2
(45) **Date of Patent: *Mar. 6, 2007**

(54) HEAD MASSAGER AND PACKAGE THEREFOR

(76) Inventor: Frank Friedland, 160 NW. 51st Ave., Boca Raton, FL (US) 33414

( * ) Notice: Subject to any disclaimer, the term of this patent is extended or adjusted under 35 U.S.C. 154(b) by 483 days.

This patent is subject to a terminal disclaimer.

(21) Appl. No.: 10/618,075

(22) Filed: Jul. 11, 2003

(65) Prior Publication Data

US 2005/0020943 A1 Jan. 27, 2005

(51) Int. Cl.
*A61H 1/00* (2006.01)

(52) U.S. Cl. ..... 601/72; 601/46; 601/67; 601/70

(58) Field of Classification Search ..... 601/1, 601/46, 67, 69, 70, 72, 73, 78, 80–82, 134, 601/136–137; 206/349, 373; 229/93
See application file for complete search history.

(56) References Cited

U.S. PATENT DOCUMENTS 5,247,925 A * 9/1993 Yamasaki et al. ..... 601/49
5,413,551 A * 5/1995 Wu ..... 601/46
6,110,102 A * 8/2000 Harrison ..... 601/46
6,319,211 B1 * 11/2001 Ito et al. ..... 601/7
6,450,980 B1 * 9/2002 Robbins et al. ..... 601/137
D473,949 S * 4/2003 Sorlie et al. ..... D24/214
6,899,106 B1 * 5/2005 Al-Killidar ..... 601/6
2002/0049400 A1 * 4/2002 Lacey ..... 601/137
2003/0083600 A1 * 5/2003 Robbins et al. ..... 601/133
2004/0049138 A1 * 3/2004 Li ..... 601/137
2005/0020944 A1 * 1/2005 Friedland ..... 601/46

* cited by examiner

*Primary Examiner*—Quang D. Thanh
(74) *Attorney, Agent, or Firm*—Martin Fleit; Paul D. Bianco; Fleit Kain Gibbons Gutman Bongini & Bianco, P.L.

(57) ABSTRACT

A head massager including a bundle of malleable rods having a top member within which the top end of the bundle of rods is fixed and the rods are free at the bottom end of the bundle, a handle including a top half and a bottom half articulated together, the bottom half defining a lower recess receiving the top member fixed therein.

14 Claims, 6 Drawing Sheets

HEAD MASSAGER AND PACKAGE THEREFOR

BACKGROUND OF THE INVENTION

1. Field of Invention

The invention relates to a head massager and a package therefor.

2. Prior Art

Head massagers are known in the art, but their construction and operation is flimsy and unstable. There still exists a need in the art for a head massager that will perform to a high standard and yet be available at a reasonable price.

SUMMARY OF THE INVENTION

The present invention has for its principal object to provide a head massager that is stable in operation, sturdy in construction and is packaged to be well presented to the buying public. This is accomplished by the invention by providing a novel construction that enables the head massager to function with and without vibration. Further, the head massager provides three different lengths of massaging rods, made of a malleable material such as copper, to be certain to provide coverage of the entire head surface. The novel head massager also is provided with protected ends for the rods that engage the head surface to insure no deleterious effects or injury. The novel head massager is provided with a light that is activated when the massager is turned on for vibration. The handle that is provided for holding the novel massage is a simulation of a head with a wizards cap; the head portion is painted with a wizard's face, and the cap portion is transparent and covered with indicia signifying magic, such as stars and crescents. A switch is provided at the top of the cap portion that when depressed, closes an electrical circuit that operates a vibration motor and lights a lamp to illuminate the transparent cap portion to give an exceptionally pleasing effect. Other and further features, advantages and objects of the invention will be more apparent from the following detailed description of a preferred embodiment when taken with the appended drawings.

DETAILED DESCRIPTION OF A PREFERRED EMBODIMENT

Figure 1:
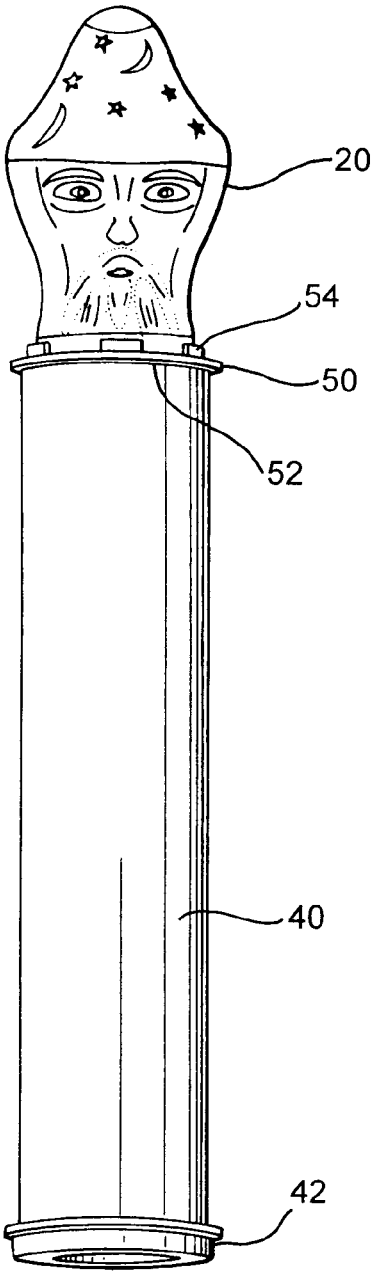
FIG. 1 is a side elevation of the novel head massager packaged but without the top cover.
Figure 2:
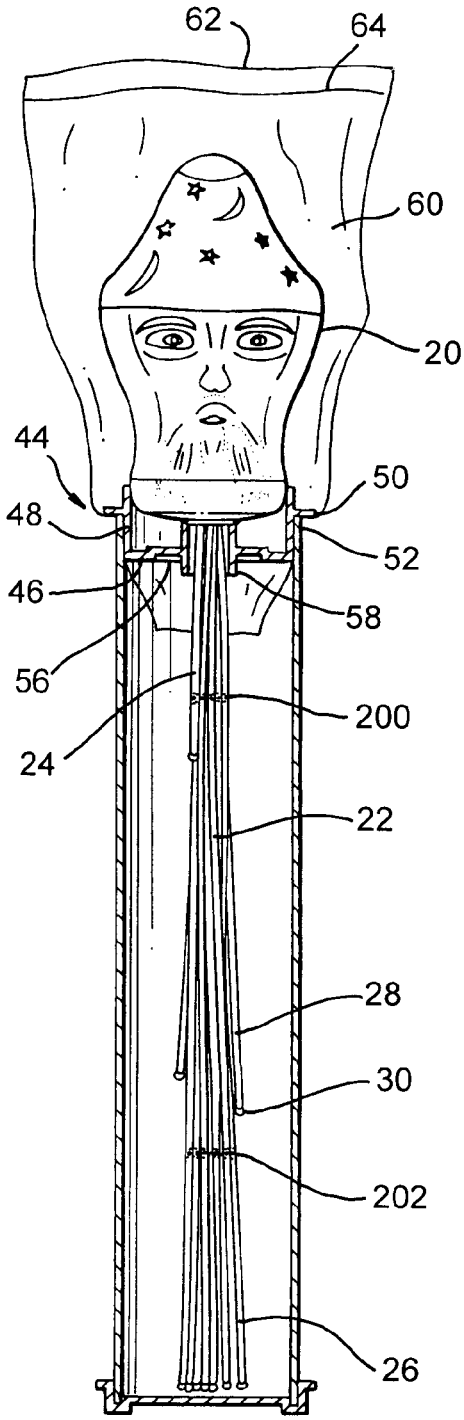
FIG. 2 is a longitudinal section of the showing of FIG. 1, and including the top transparent cover for the head.
Figure 3:
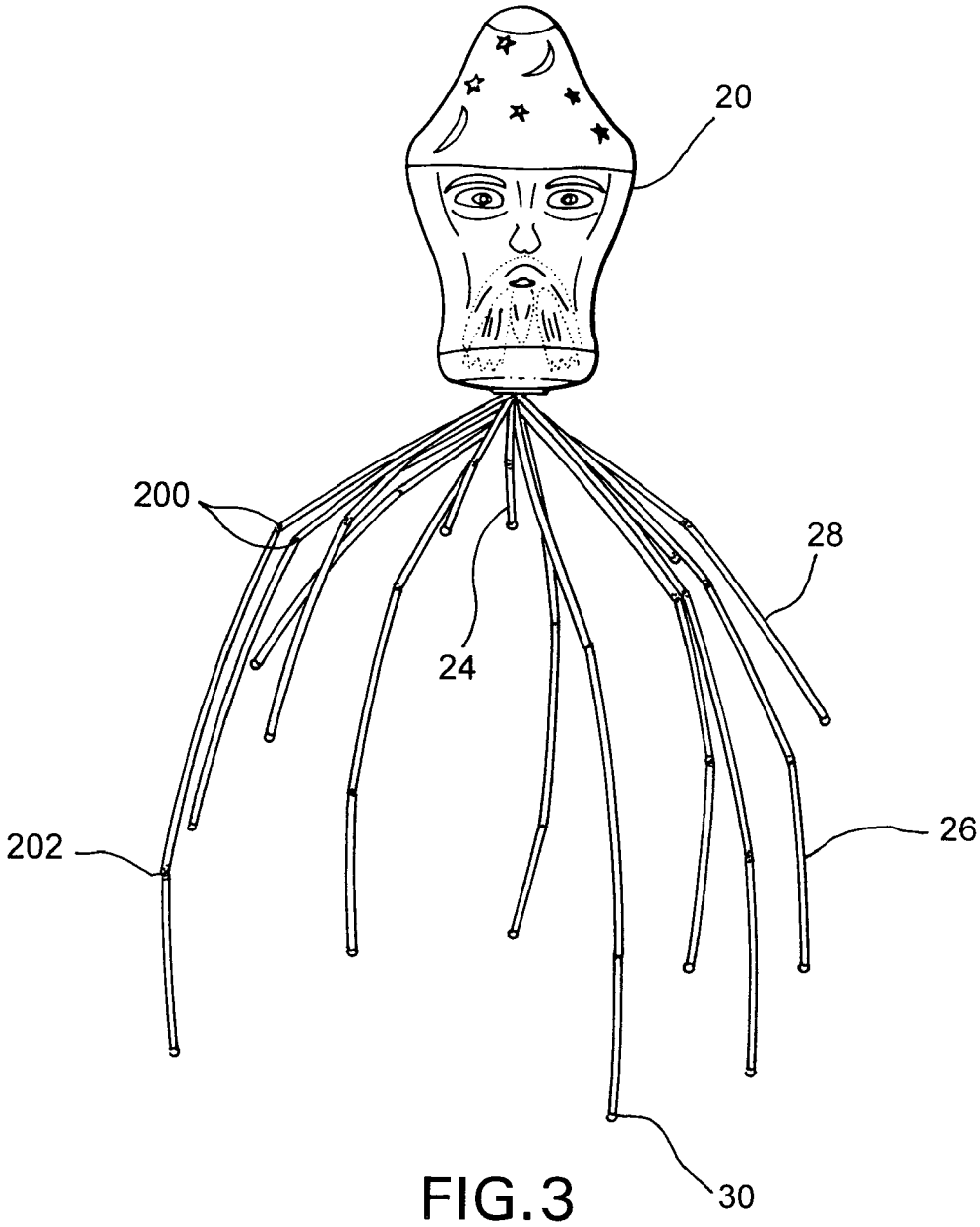
FIG. 3 is a side elevation of the novel head massager removed from its package and ready for use.
Figure 4:
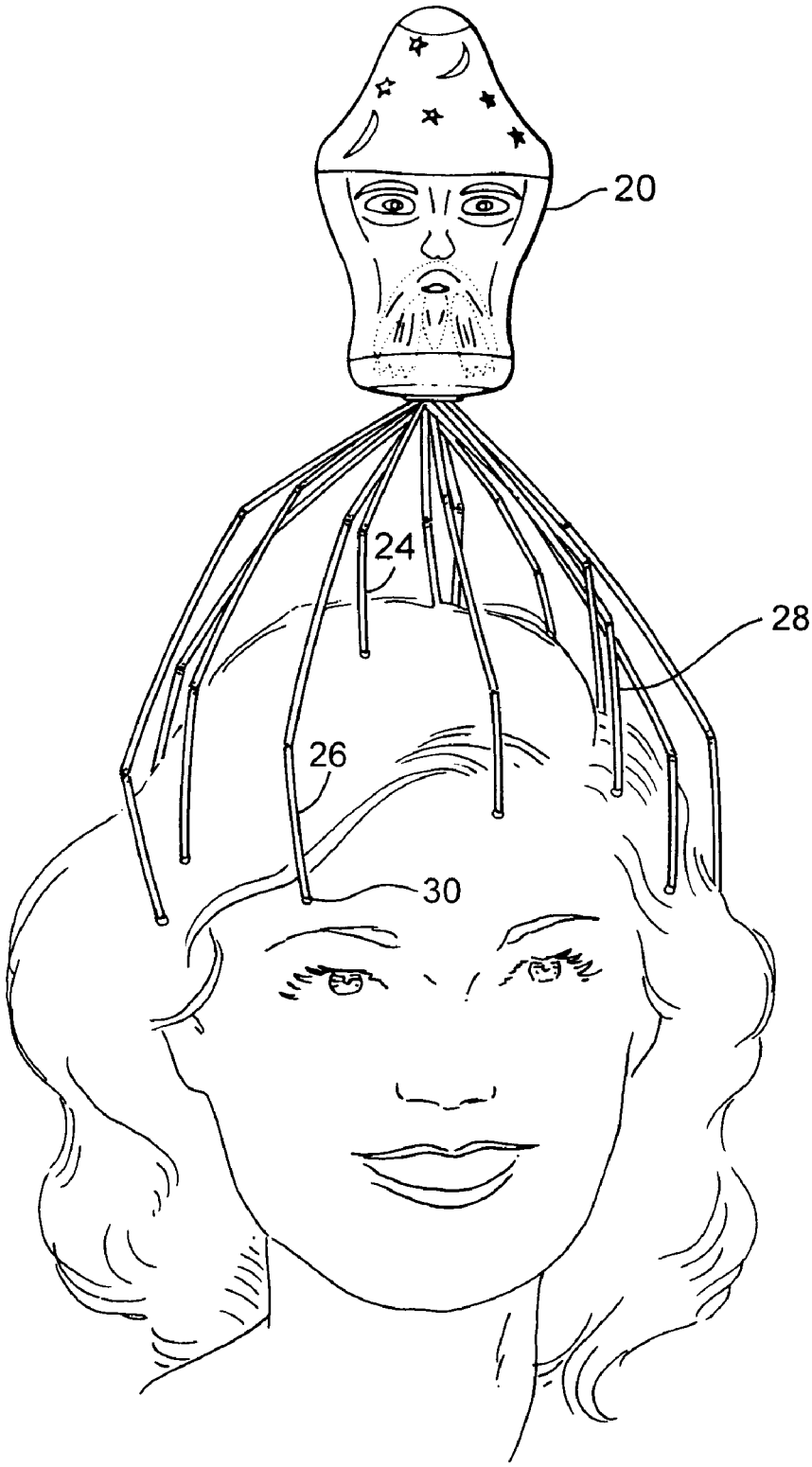
FIG. 4 is a side elevation showing the novel head massager in use on a person's head.

Referring now to the drawings, the novel head massager will be described. As shown in FIGS. 1 and 2, the novel head massager consists of a head 20 from which project a plurality of rods 22 in a bundle. Head 20 has painted or coated thereon a simulation of a wizard's face on the lower half and a simulation of a cap with stars and crescents on the top half, which is transparent. The halves are articulated as will be explained in detail hereinafter. Rods 22 are made of a malleable material, preferable copper, so that they can be bent and placed in a variety of configurations for massaging the head, and will hold the set configuration until otherwise changed. There are three lengths of rods 22, as best seen in FIG. 3. A short length 24, a long length 26, and an intermediate length 28 to enable the rods to be deployed by bending to conform to the various areas of the head. Use of three lengths gives better contact and coverage than was possible with prior art designs for head massagers. Also, the ends of the rods 22 are covered with a drop or ball of plastic or rubber 30 that serves as a safety measure to prevent any damage to the head during massage. FIG. 4 shows the novel head massager in use on a person's head; it will be noted that the three lengths of rod 20 enable the head massager to reach and cover the head area most effectively while the safety measure of balls or drops 30 insure a safe massage.

The head massager is packaged in a tube of cardboard 40 closed at its bottom by a plastic closure 42 that is press fitted into the tube end. The bundle of rods 22 receive an integrally molded top plastic closure 44 that has a cup shape with a bottom 46 and an upward extending cylindrical skirt 48. An outer flange 50 projects from the upper portion of skirt 48 that engages the top edge 52 of tube 40. The skirt 48 is press fit into the top end of tube 40 and retained therein by pressure. Upstanding tabs 54 are located intermittently around the top edge of the skirt 48 and engage the bottom portion of the head 20, as best seen in FIG. 2. The bottom 46 has an upward recess 56 at it central portion and a central tube 58 extends vertically above the bottom 46 to engage at its top the bottom of the head 20 and provide a support of it, and extends vertically below the bottom 46 to contain and control the bundle of rods 22. Thus, the head 20 is securely and stably supported by the top of tube 58 and the tabs 54 while the rods 22 are contained within the tube 40 in a secure packed fashion with the help of the tube 58. A tubular plastic bag 60, heat sealed at its top 62 by heal seal 64 covers head 20 with the open bottom of the bag 60 fitted into tube 40 between the closure 44 and tube 40 and held therein by the press fit.

Figure 5:
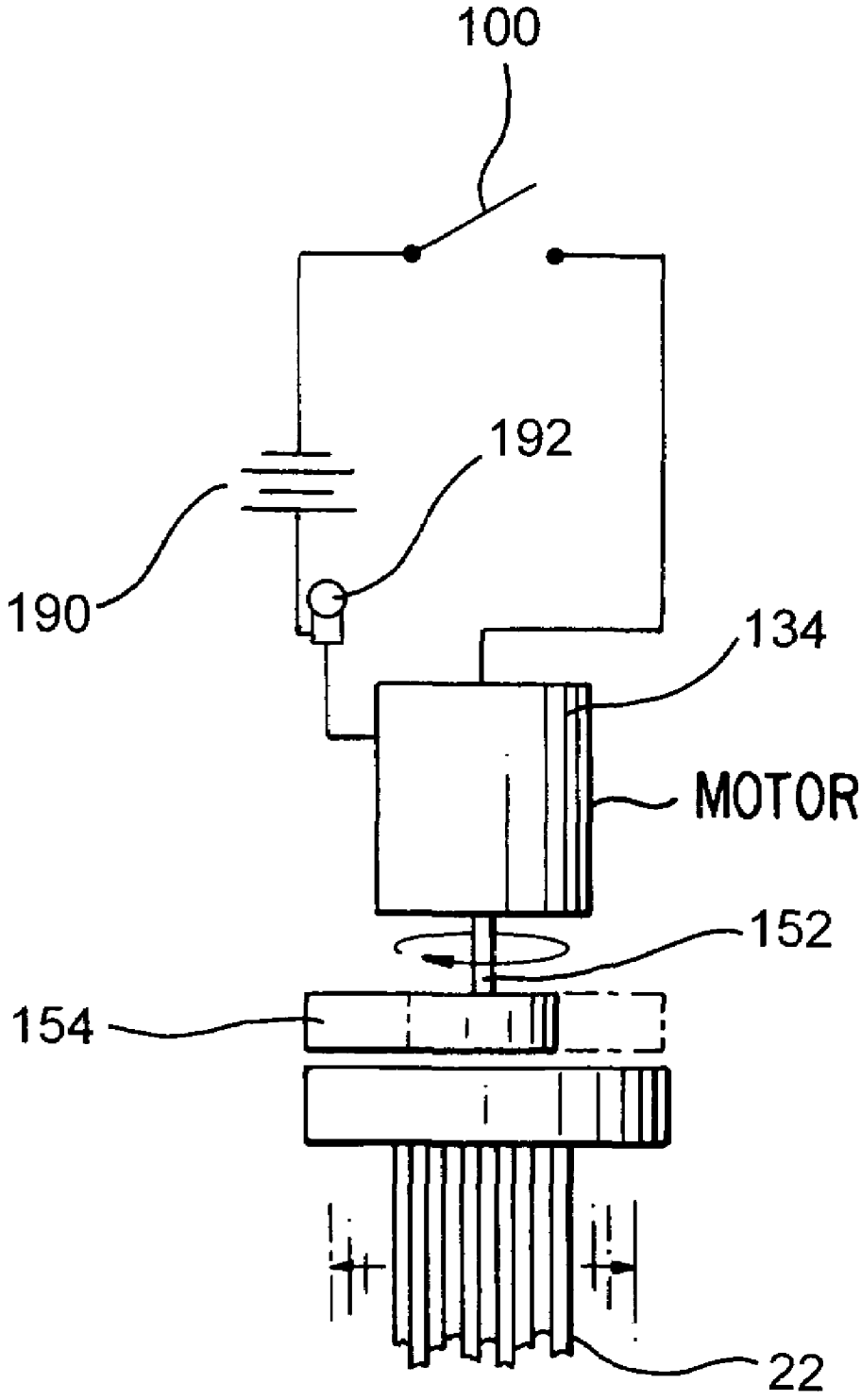
FIG. 5 is a schematic view showing the electrical circuit and the vibration effect.
Figure 6:
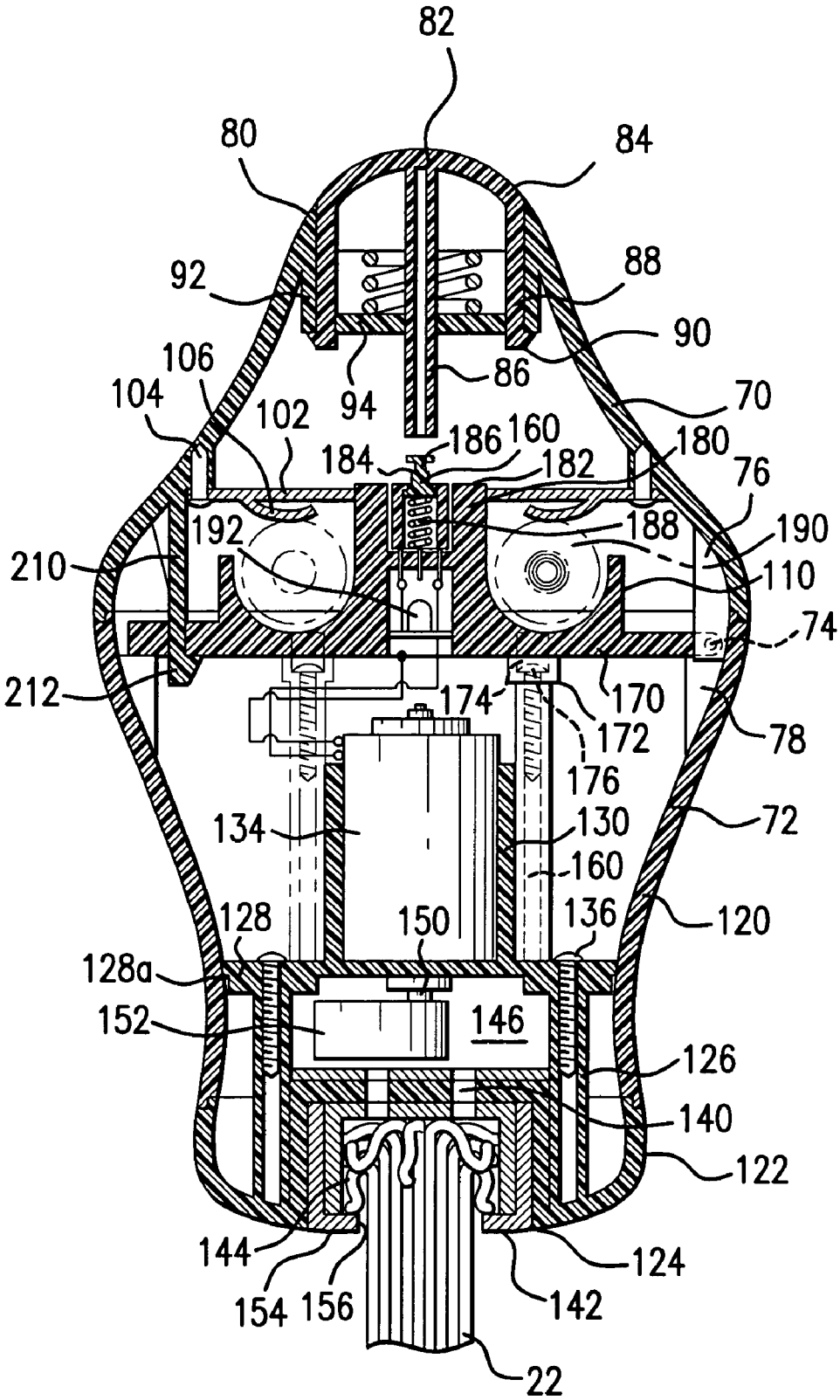
FIG. 6. is a sectional view through the head of the novel massager, the section being taken in a mid-plane at right angle to the battery axes.
Figure 7:
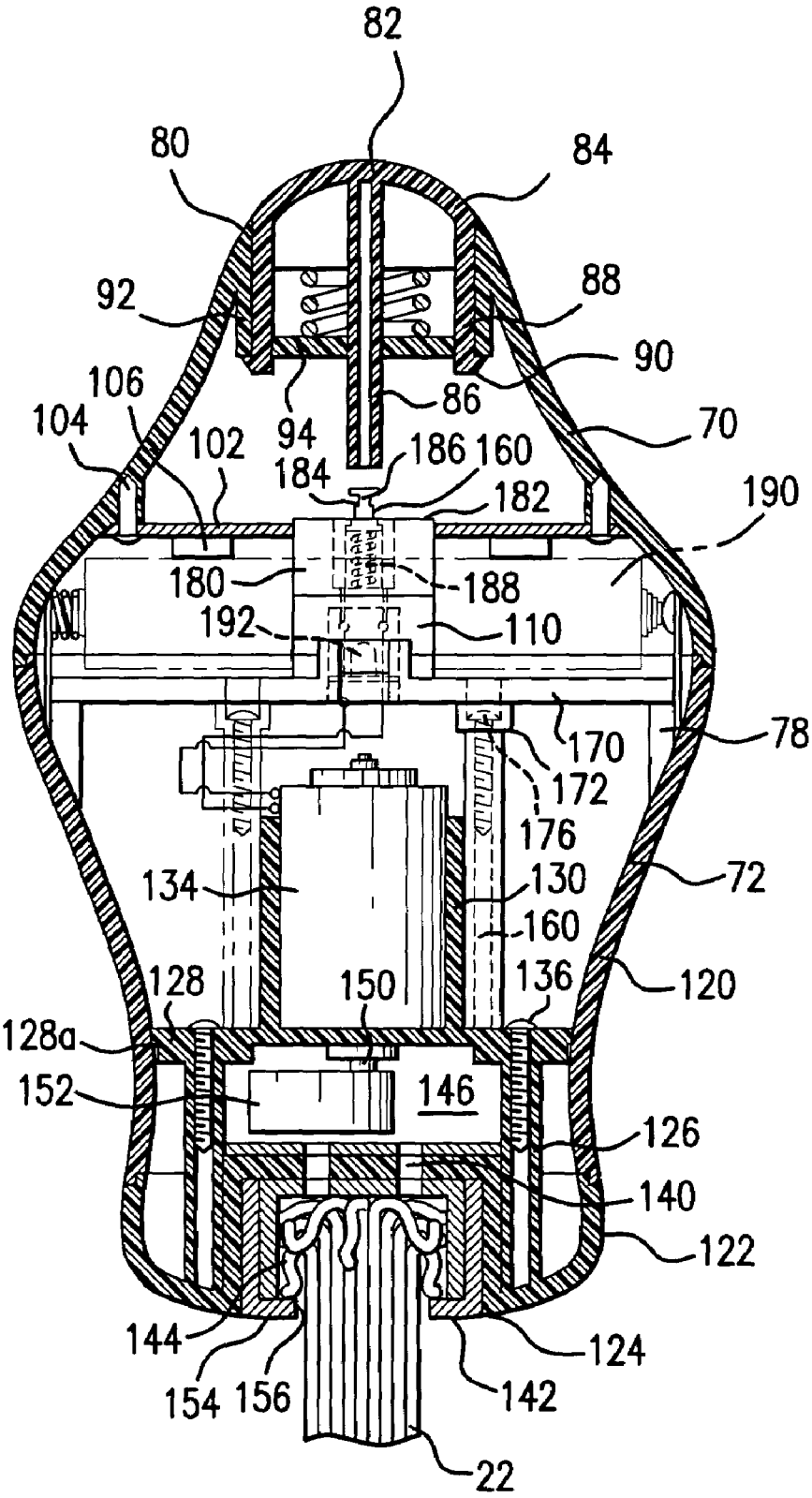
FIG. 7 is a sectional view through the head of the novel massager, the section being taken in a mid-plane parallel to the battery axes.

Referring now to FIGS. 5, 6 and 7 the head construction and electrical circuitry will be explained. The head 20 consists of top transparent half 70 and bottom opaque half 72 articulated together by a hinge 74 that pivotally connects web 76 integrally formed with the top half 70 and web 78 integrally formed with the bottom half 72, see FIG. 6. Web 78 is one of a plurality of reinforcing webs that are disposed intermittently spaced about the inner surface of the lower half 72. The top half 70 consists of a generally conical shape decorated with stars and crescents that has a top central opening 80 into which is placed or received a push button 82. Button 82 consists of a main cylindrical hollow body 84 and has a central tube or push rod 86 depending from the top of the button 82 downward terminating spaced above a switch 100 mounted on the bottom half 72. Button 82 has an integrally formed pair of struts 88 having hooks 90 at their lower free ends that constitute the attachment of the button 82 with the skirt 92. Hooks 90 are pushed through openings in and locked into the floor 94 that closes the bottom end of a downward skirt 92 forming the opening 80 in the top of the top half 70. Push button 82 has a web 96 spaced above floor 94 and a spring 98 is placed against the floor 94 and urges the push button to a repose position fully upward, as shown in FIG. 6. A battery pressure plate 102 is fastened to the top half 70 by fasteners 104 at a point where the diameter is narrowing. The underneath side of the plate 102 has resilient curved or bent metal elements 106 to press against batteries 108 to hold them in place in their saddles 110.

The bottom half 72 consists of an open-ended cylindrical main body 120 having a modified spool shape to simulate a face. The lower end is closed by a cap 122 by heat sealing or adhesively. Cap 122 defines a cavity 124 for receiving a member holding the top end of the bundle of rods 22. Cap 122 has four integrally formed posts 126 that extend upward into the main body 120. A plate 128, providing an integrally formed mounting cylinder 130 for a motor 134, is connected to the posts 126 by screws 136. Plate 128 is drawn down to a seat 128*a* defined by a narrowing of the inner diameter of the main body 120; this insures a stable construction. The top of the cavity 124 has three holes 140 for connecting the member holding the top of the rod bundle. The top of the rod bundle is captured in two inverted metal cups 142 and 144 that are press fit together while crushing, due to their malleability, the tops of rods 22 into the space defined within the cups. The cup 142 defines a flange 154 surrounding an opening 156 through which the bundle of rods 22 protrudes. The cup 144 defines three holes matching or registering with the holes in the cap 122, and screws (not shown) thread into the holes to hold the inverted cups 142 and 144 in the cavity 124 in the cap 122. A space 146 is defined below plate 128 and above the connection of the rod bundle in which is located the drive shaft 150 of the motor 134 and an eccentrically mounted flywheel magnet 152 fixed to shaft 150. As the motor 134 drives the eccentric flywheel magnet 152 via the shaft 150, the action causes the bundle of rods 22 to vibrate.

Integrally formed on plate 128 are two posts 160 that extend upwardly to above the motor 134. A battery holding plate 170 has two depending bosses 172. Wells 174 are defined by the plate 170 and the bosses 172. The bosses 172 register with the posts 160 and screws 176 threadedly connect the bosses 172 and plate 170 with the two posts 160. Battery plate 170 defines two saddles 110 for holding batteries, that are aligned vertically with the bent resilient tabs 106 so that when a battery 190 is seated in its saddle 110, the resilient bent metal tab 106 will apply pressure to hold the battery 190 securely in position, while allowing easy replacement as needed. The central portion of the plate 170 defines an upward cylindrical projection 180 having a central recess 182 within which is located a switch 100 consisting of a plunger 184 resiliently biases upward by spring 186 situated in a chamber 188. The plunger 184 is depressed downward against the bias of spring 186 to close an electrical circuit that supplies power to the motor 134, see FIG. 5. A light 192 is in circuit serially, to light when switch 100 is closed. Switch 100 is closed only when the push button 82 is depressed to cause the rod 86 to contact the switch 100 and close it. This action is conveniently effected usually by the thumb of the user while grasping the handle in one hand. Also, by repeatedly flicking the push button 82 down and releasing a flashing effect can be generated. As the top half of the handle is transparent, a very pleasing effect is created.

The top half 70 is articulated to the bottom half 72, as explained. Top half 70 includes a strut 210 that is integrally formed with the top half 70. Strut 210 depends vertically downward and terminates at its free end in a hook 212. When the top half 70 is closed to the bottom half 72, hook 212 latches beneath the battery plate 170 and snaps into latching condition to attach the top half 70 to the bottom half 72. However, it is possible to easily detach or unlatch the hook 212. This is done by pressing in on the resilient transparent top half 70 while pulling upward. This action is sufficient to detach the hook 212 from the battery plate 170 to enable the top half 70 to swing upward about the hinge 74 to expose the interior of the handle.

To unpack and deploy the head massager, the top closure 44 is removed, the bag 60 is taken off the head, the top closure is slid off the bundle of rods 22, and the rods 22 are deployed by bending into the pattern shown in FIGS. 3 and 4. All the rods 22 are daubed with a contrasting paint to show where to make bends, see FIG. 2, which shows paint at 200 approximately ¼ down the length of the long rods 26 and at 202 approximately ¾ down the length of the long rods 26. For example, if the rods are copper, the paint can be red. The short rods 24, intermediate rods 28 and the long rods 26 are daubed at 200 and the long rods 26 are daubed at 202 for a second bend. Initially the rods are deployed at angles from approximately 30 to 60 degrees directly where they emerge from the bottom of the head and distributed circumferentially around 360 degrees so that the long rods 26 are the most spread, the intermediate rods 28 are within the profile of the long rods 26, and finally the short rods 24 are within the profile of the intermediate rods 28. Next all rods 22 are bent at the painted area 202 to depend more downwardly. When finished, the ends of the rods 22 will contact a person's head all over its upper surface as shown in FIG. 4. The plastic or rubber balls 30 covering the ends of the rods 22 will provide suitable protection so that the person's scalp or skin will not be injured. The head massager then can be used with or without vibrations, as the user's chooses.

Although the present invention has been described in terms of a preferred embodiment, nevertheless changes and modifications will be apparent to those skilled in the art from the teachings herein. Such changes and modifications are deemed to fall within the purview of the invention as claimed.

What is claimed is:

1. A packaged head massager comprising:

a cardboard tube, a first closure for one end of the tube, a second closure for the other end of the tube comprising an integral plastic molded cup-shaped element defining an outer flange around it upper portion, a series of intermittently spaced tabs vertically extending from its upper portion and a central cylindrical tube, a head massager comprising a bundle of malleable rods having a top member within which the top end of the bundle of rods is fixed and the rods are free at the bottom end of the bundle, a handle including a top half and a bottom half articulated together, the bottom half defining a lower recess receiving the top member fixed therein, a motor having an output shaft on which is eccentrically mounted a magnet mounted in the bottom half with the eccentrically mounted magnet lying in juxtaposition to but spaced from the top member, a battery receiving plate mounted in the bottom half, an electrical circuit coupling the battery receiving plate and motor, a switch mounted in the bottom half, and a manually operable switch actuator mounted in the top half for actuating the switch to enable power to be supplied to the motor when batteries are mounted onto battery receiving plate, said bundle of rods extending through said central tube of the second closure and into the cardboard tube, the handle lying outside the cardboard tube resting on the central tube and spaced tabs, and a tubular plastic bag heat sealed at one end and open at the other end the sealed end covering the handle, and the open end of the bag lying inside the cardboard tube is trapped between the second closure and to cardboard tube.

2. A head massager according to claim 1 wherein the switch includes a spring biased plunger.

3. A head massager according to claim 1 wherein the manually operable switch actuator includes a spring biased push button and actuating rod for contacting and closing the switch.

4. A head massager according to claim 1 wherein a light is included in the electrical circuit.

5. A packaged head massager comprising:

a cardboard tube, a first closure for one end of the tube, a second closure for the other end of the tube comprising an integral plastic molded cup-shaped element defining an outer flange around it upper portion, a series of intermittently spaced tabs vertically extending from its upper portion and a central cylindrical tube, a head massager comprising a bundle of malleable rods having a top member within which the top end of the bundle of rods is fixed and the rods are free at the bottom end of the bundle, and a handle including a top half and a bottom half articulated together, the bottom half defining a lower recess receiving the top member fixed therein, said bundle of rods extending through said central tube of the second closure sect into the cardboard tube, the handle lying outside the cardboard tube resting on the central tube and spaced tabs, and a tubular plastic bag heat sealed at one end and open at the other end, the sealed end covering the handle, and the open end of the bag lying inside the cardboard tube is trapped between the second closure and the cardboard tube.

6. A head massager according to claim 5 wherein the top half is transparent.

7. A head massager according to claim 5 wherein the handle is decorated with figures.

8. A head massager according to claim 7 wherein the bottom half is decorated with the face of a wizard.

9. A head massager according to claim 5 if wherein a readily attachable and detachable latch couples the top half to the bottom half.

10. A head massager according to claim 5 wherein the bundle of rods contains rods of three different lengths.

11. A head massager according to claim 10 wherein a visual indicator is marked on the bundle of rods showing where bends occur during rod deployment.

12. A head massager according to claim 11 wherein one visual indicator is marked on the rods about ¾ of the length of the longest rods from the handle, and a second visual indicator is marked on the longest rods ¾ of their length form the handle.

13. A head massager according to claim 5 wherein protective coverings are mounted on the free ends of the rods.

14. A head massager according to claim 13 wherein plastic or rubber balls constitute the protective coverings.

* * * * *